US006529109B1

(12) United States Patent
Shikama et al.

(10) Patent No.: US 6,529,109 B1
(45) Date of Patent: Mar. 4, 2003

(54) BEAD INDUCTOR

(75) Inventors: Takashi Shikama, Yokaichi (JP); Masami Sugitani, Omihachiman (JP); Hisato Oshima, Yokaichi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/690,871

(22) Filed: Oct. 17, 2000

Related U.S. Application Data

(62) Division of application No. 09/336,010, filed on Jun. 18, 1999, now Pat. No. 6,189,204.

(30) Foreign Application Priority Data

Jun. 23, 1998 (JP) ..... 10-175649

(51) Int. Cl.[7] ..... H01F 27/02
(52) U.S. Cl. ..... 336/83; 336/192; 336/200
(58) Field of Search ..... 336/65, 83, 192, 336/200, 223, 233; 29/602.1, 605, 608

(56) References Cited

U.S. PATENT DOCUMENTS 6,189,202 B1 * 2/2001 Masuda et al. ..... 29/605

FOREIGN PATENT DOCUMENTS

| | | | |
|---|---|---|---|
| JP | 63-79306 | * | 4/1988 |
| JP | 5-217750 | * | 8/1993 |
| JP | 6-140252 | * | 5/1994 |
| JP | 8-191022 | | 7/1996 |

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

A bead inductor includes a conductor coil defined by a wound, coated metallic wire, and an insulation coating which is removed on both end portions thereof. The conductor coil is embedded in a molded body with the end portions of the conductor coil being exposed at both end portions of the molded body. External terminals are attached to end portions of the conductor coil at both ends of the molded body so that the external terminals are electrically connected to the end portions of the conductor coil.

10 Claims, 6 Drawing Sheets

BEAD INDUCTOR

This is a divisional application of application Ser. No. 09/336,010, filed on Jun. 18, 1999 now U.S. Pat. No. 6,189,204.

BACKGROUND OF THE INVENTION

1. Field of the Invention

The present invention relates to a method of manufacturing a bead inductor and also relates to a bead inductor produced by such a method and constructed for use in noise control circuits and other electronic components.

2. Description of the Related Art

As a noise-controlling device, particularly a device for use with a microprocessor, for example, which is required to carry a large electric current therethrough, a bead inductor has been proposed. A bead inductor which is an experimental device and has not been publicly disclosed, is formed of a resin material or a rubber material including a powdered magnetic substance, such as ferrite powder, with a conductor coil embedded therein. In this bead inductor, a conductor coil is embedded into a resin material or a rubber material via injection molding, etc., to form a molded body which is cut off at both ends thereof to expose both ends of the embedded coil. Then, metal caps are connected thereto by conductive resin paste or spot welding so as to define external terminals.

FIGS. 5 and 6 are sectional views illustrating a method for manufacturing such an experimental bead inductor. Referring to FIGS. 5 and 6, a metallic mold for injection molding to manufacture the bead inductor includes an upper mold 1 and a lower mold 2. A cavity is formed in the upper mold 1 and defines a space for molding a resin member. In the lower mold 2, a pin 4 is provided so as to be disposed in the cavities 3 when the upper mold 1 and the lower mold 2 are mated with each other. The upper mold 1 has a gate 1*a* for supplying a melted resin material into the cavity 3.

In order to manufacture a molded body of the bead inductor using the metallic mold shown in FIG. 5, the pin 4 is inserted into a conductor coil, which is defined by a wound, coated metallic wire. The metallic wire may be a copper wire and is preferably coated with a polyester resin, etc., for insulation. Then, the melted resin including a powdery magnetic substance such as ferrite powder is injected into the cavity 3 via the gate 1*a*. As a result, the outer portion of the conductor coil having the pin 4 inserted therein is molded of the melted resin.

FIG. 6 is a sectional view showing the state of the outside portion of a coil 5 molded in this manner. After the step shown in FIG. 5, the pin 4 is removed and the same resin material used on the outside portion of the coil 5 is injected into the space produced by the removing the pin 4, so as to mold the inside of the coil 5 of the melted resin, so that the coil 5 is embedded in the resin.

FIG. 7 is a sectional view showing a molded body obtained in this manner. The molded body 7 is formed of a molded resin portion 6 with the conductor coil 5 embedded therein. In FIG. 7 and other drawings which will be described in relation thereto, illustration of the molded resin portion 6 disposed in the inside 5*a* of the conductor coil 5 is omitted. The inside 5*a* of the conductor coil 5 is filled with the same resin as the outside molded resin portion 6.

In FIG. 7, lines A—A and B—B show cutting lines. The molded body 7 is cut off along the cutting lines via a dicing saw, or other cutting device, so that connecting terminal portions of the conductor coil 5 are exposed at the ends of the molded body. Metallic caps are mounted onto the connecting terminal portions of the coil which are exposed by the cutting. The metallic caps and the connecting terminal portions of the conductor coil are electrically connected to each other via conductive resin paste, spot welding, or the like.

FIG. 11 is a side view showing a bead inductor with the metallic caps attached thereto in this manner, while FIG. 12 is a plan view thereof. As shown in FIGS. 11 and 12, the metallic caps 8 and 9, which define external terminals, are attached to both ends of the molded body 7. As described above, the metallic caps 8 and 9 are electrically connected to the connecting terminal portions of both ends of the conductor coil 5 within the molded body 7.

When such a bead inductor is produced by the above-described method, there has been a problem of a low degree of reliability in the electrical connection between the inside conductor coil and the external terminal. That is, when the molded body 7 shown in FIG. 7 is cut off along the cutting lines A—A and B—B, the inside conductor coil may not be cut off along the cutting lines in one plane, resulting in a low degree of reliability of electrical connection.

FIG. 8 is a sectional view showing a cut-away section of the conductor coil in this case. The cut-away plane 7*a* of the molded body 7 is a cut-away surface when the molded body 7 is cut off along the cutting line A—A shown in FIG. 7, while the end portion 5*c* of the conductor coil 5 is cut along the plane so as to be flush with the cut-away plane 7*a*. FIG. 9 is a cross-sectional view showing the end portion 5*c*, in which a wire material such as a copper wire disposed in an insulation coating is exposed.

In contrast, the portion which is cut along the cutting line B—B shown in FIG. 7 corresponds to the cut-away plane 7*b* shown in FIG. 8, and the conductor coil 5 is not cut along the cut-away plane 7*b*, so that the wire material of the conductor coil 5 is cut off in a torn-off state to form the end portion 5*b* shown in FIG. 8.

FIG. 10 is a side view showing the state of the end portion 5*b* shown in FIG. 8. Since the wire material of the conductor coil 5 is coated for insulation by a resin layer, the inside wire material portion is exposed at only the end portion 5*b* in the cut-away plane 7*b* as shown in FIG. 10, leaving other portions covered by the insulation coating. In this state, the end portion 5*b* having a small area should be electrically connected to the metal cap, resulting in a low degree reliability of the connection.

SUMMARY OF THE INVENTION

To overcome the problems described above, preferred embodiments of the present invention provide a method of manufacturing a bead inductor such that the bead inductor produced thereby has a greatly improved and much more reliable connection between the conductor coil and the external terminals.

One preferred embodiment of the present invention provides a method for manufacturing a bead inductor including the steps of forming a molded body of a resin material or a rubber material including a powdered magnetic substance, the molded body including a conductor coil defined by a wound, coated metallic wire, and being embedded in the resin body; cutting both ends of the molded body so as to expose end portions of the conductor coil; and attaching external terminals to the exposed end portions of the conductor coil so that the external terminals are electrically connected to the conductor coil, wherein both end portions of the conductor coil are immersed into a melted solder bath prior to the forming step so as to include in the melted solder bath cutting regions of both end portions of the molded body such that insulation coating on both end portions of the conductor coil is removed.

According to the first preferred embodiment of the present invention, since insulation coating on both end portions of the conductor coil is removed by immersing both end portions thereof into a melted solder bath prior to the molded body forming step, even if the conductor coil is cut in a state of the cut-away plane 7*b* shown in FIG. 8, insulation coating on the conductor coil exposed on the cut-away plane 7*b* is removed. Therefore, a sufficient connecting area for connecting to external terminals can be secured, resulting in greatly increased connecting reliability.

The step of attaching external terminals according to preferred embodiments of the present invention may be performed by soldering of the external terminals to the exposed end portions of the conductor coil.

In this case, soldering is performed by immersing both end portions of the conductor coil into a melted solder bath in advance. Therefore, excellent solder-wetting properties permit greatly improved soldering when external terminals are soldered, resulting in further increases in connection reliability.

The region of one end portion of the conductor coil which is immersed in the melted solder bath according to preferred embodiments of the present invention may be the region defined by one to five turns, preferably one to three turns, of the conductor coil from an end thereof.

In this case, in a bead inductor of general design, the conductor coil can be immersed in a melted solder bath so as to include the cutting region therein defined by the above-mentioned range of the region of immersing of one end portion of the conductor coil.

In accordance with another preferred embodiment of the present invention, a bead inductor includes a conductor coil defined by a wound, coated metallic wire and insulation coating on both end portions of the conductor coil having been removed; a molded body formed of a resin material or a rubber material including a powdered magnetic substance with the conductor coil embedded therein so that the end portions of the conductor coil, from which insulation coating thereon is removed, are exposed at both end portions of the molded body; and external terminals are attached to the end portions of the conductor coil at both end portions of the molded body so that the conductive coil is electrically connected to the external terminals. The bead inductor according to another preferred embodiment of the present invention can be manufactured by the manufacturing method according to the first preferred embodiment of the present invention.

The external terminals according to this preferred embodiment of the present invention may be metallic caps which are fitted to both end portions of the molded body.

The above-mentioned elements, features, characteristics and advantages of the present invention are further clarified by the following detailed description of preferred embodiments referring to the drawings.

DETAILED DESCRIPTION OF PREFERRED EMBODIMENTS

Figure 1:
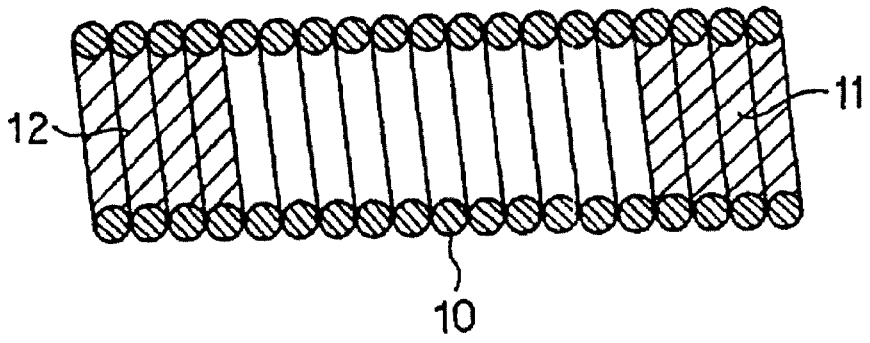
FIG. 1 is a sectional view of a conductor coil according to a preferred embodiment of the present invention.

FIG. 1 is a sectional view of a conductor coil used in a preferred embodiment according to the present invention. The conductor coil 10 preferably includes a metallic wire which is coated for insulation. For example, the conductor coil 10 may be a copper wire coated with a polyester resin. Soldering treatment for removing the insulation coating at both end portions of the conductor coil 10 is preferably performed by immersing both end portions thereof into a melted solder bath. In FIG. 1, hatched regions show soldered portions 11 and 12 treated in this manner. In the soldered portions 11 and 12, the insulation coating layer is melted and removed when the end portions are immersed in the melted solder bath, such that solder is deposited on the surface of the metallic wire. In this preferred embodiment, the total length of the conductor coil is preferably about 6 mm, while the lengths of the soldered portions 11 and 12 are preferably approximately 1 mm, respectively. Each region of the soldered portions 11 and 12 is preferably a region located within four turns of the wire of the coil from an end of the coil 10.

Figure 5:
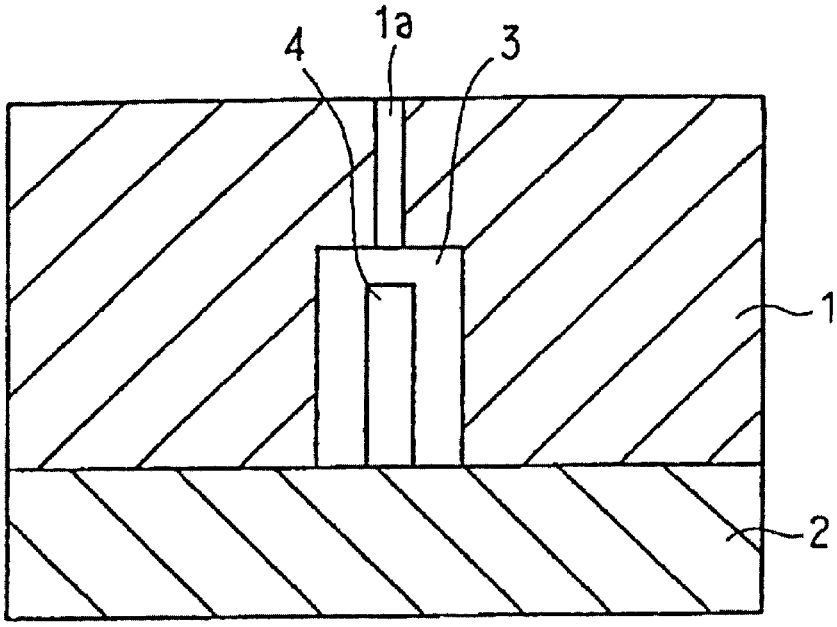
Fig.5 PRIOR ART
FIG. 5 is a sectional view showing a metallic mold for injection molding for embedding the conductor coil therein.
Figure 6:
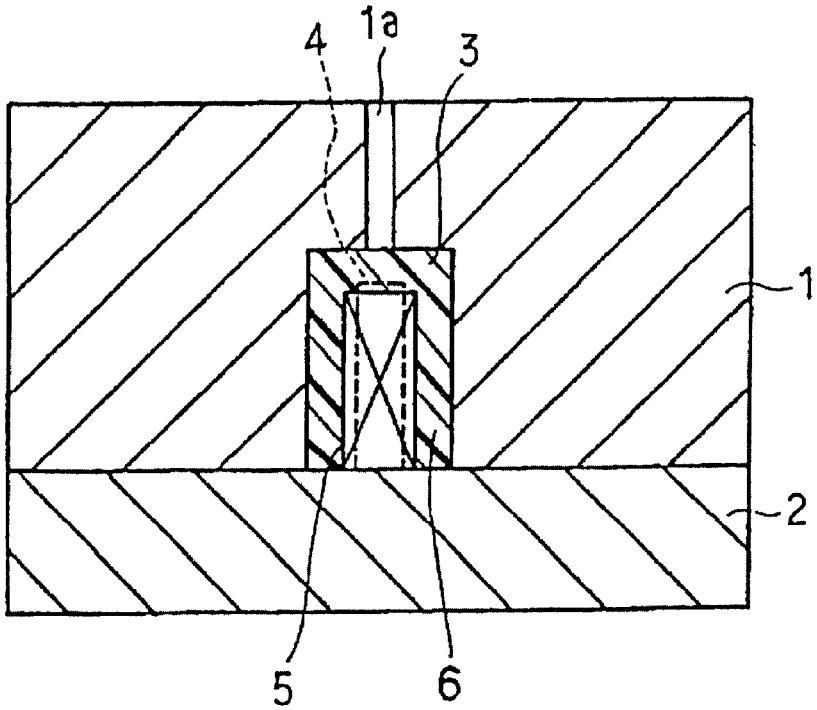
Fig.6 PRIOR ART
FIG. 6 is a sectional view showing a metallic mold for injection molding for embedding the conductor coil therein, the coil, and the state of the outside of the coil formed by the resin body.
Figure 7:
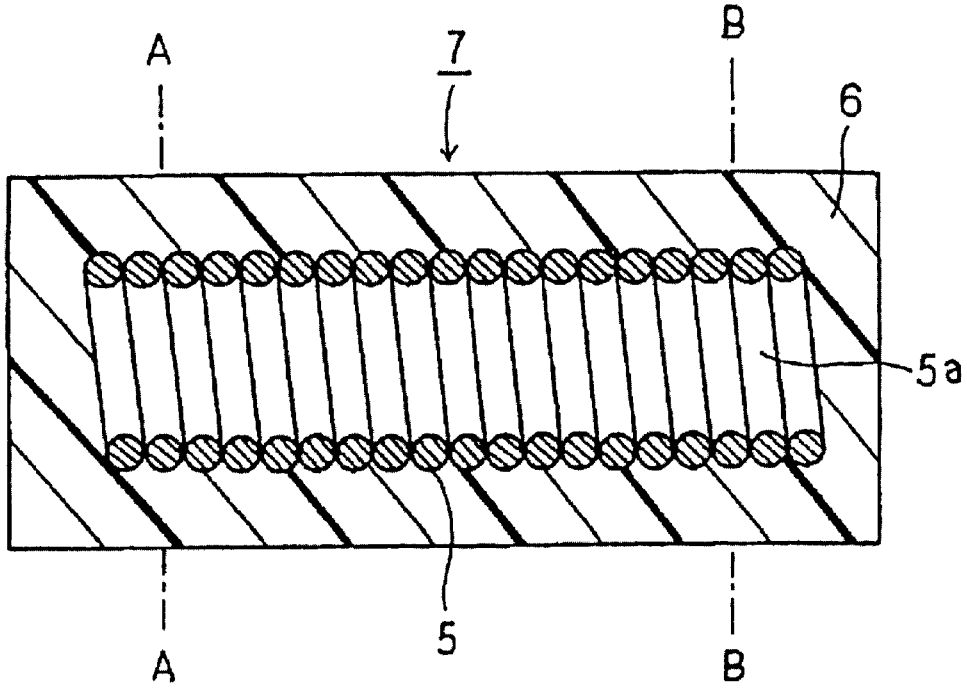
Fig.7 PRIOR ART
FIG. 7 is a sectional view showing a molded body with a conductor coil embedded in the resin thereof in a manufacturing process of a bead inductor related to the present invention.

The molded body is preferably formed so that the conductor coil 10 treated by soldering in this manner is embedded in a resin body preferably including ferrite powder, utilizing a metallic mold for injection molding shown in FIG. 5.

Figure 2:
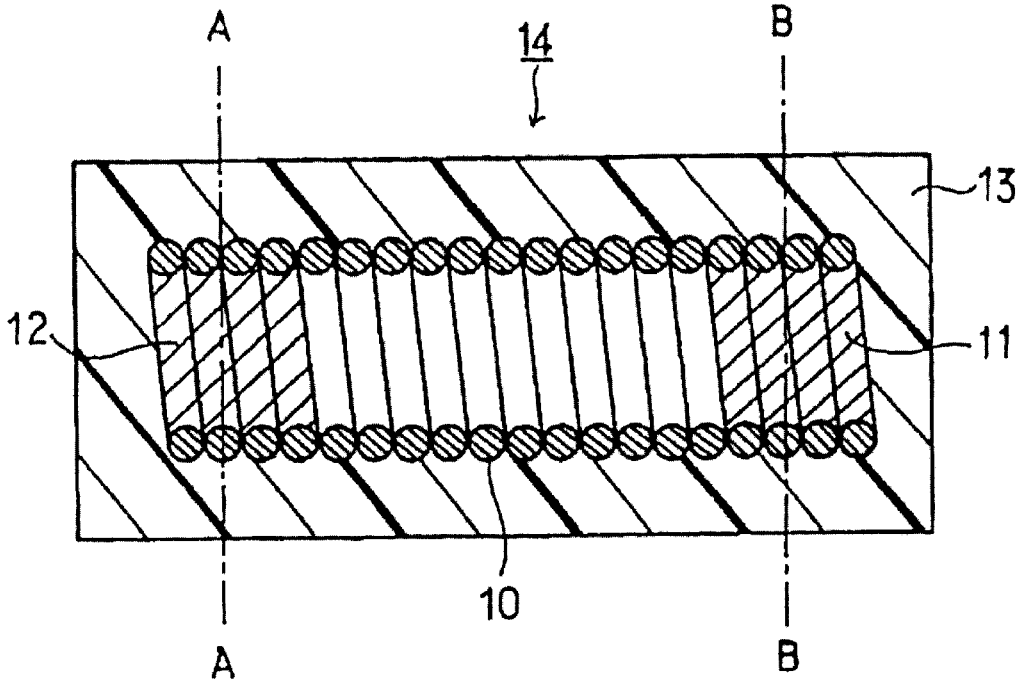
FIG. 2 is a sectional view showing a molded body with the conductor coil embedded in a resin body according to a preferred embodiment of the present invention.

FIG. 2 is a sectional view showing a molded body 14 with the conductor coil 10 being embedded therein by injection molding. As for the resin including ferrite powder, for example, a PPS (polyphenylene sulfide) resin including about 88% by weight of a Ni—Cu—Zn ferrite powder can be preferably utilized.

As shown in FIG. 2, in the molded body 14, the conductor coil 10 is embedded into a molded resin portion 13. In FIG. 2, illustration of the molded resin portion 13 in the inside of the conductor coil 10 is omitted so as to show the inside of the conductor coil 10. The lines A—A and B—B show cutting lines along which the resin molded body 14 is cut by a dicing saw or other cutting device. As shown in FIG. 2, the cutting line A—A is included within the region of the soldered portion 12 of the conductor coil 10, while the line B—B is included within the region of the soldered portion 11.

In this preferred embodiment, each cutting line is established so that the length of the molded body 14 after being cut off along the cutting lines A—A and B—B is preferably about 4.3 mm.

Figure 3:
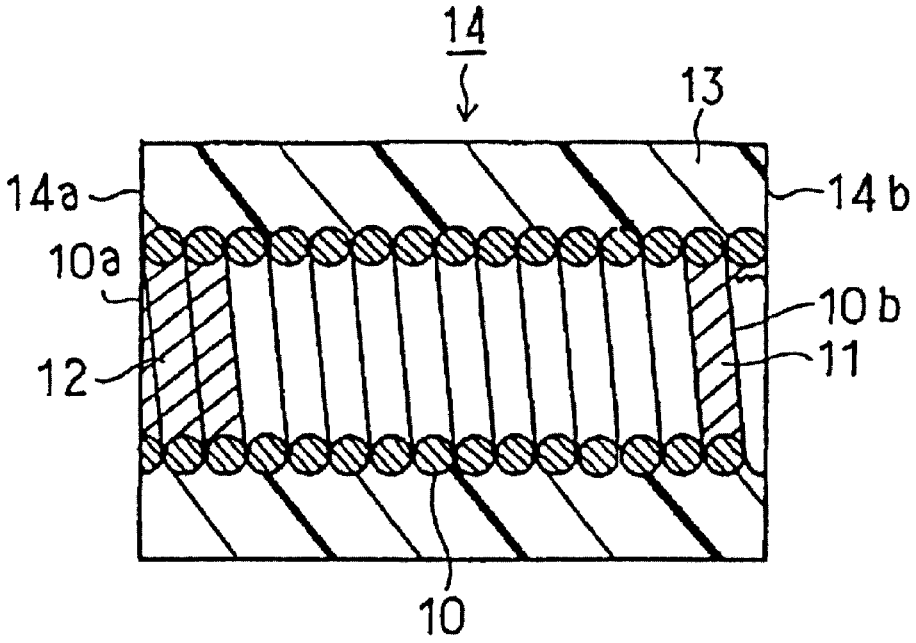
FIG. 3 is a sectional view showing the state of the molded body shown in FIG. 2 after being cut off at both ends thereof.
Figure 8:
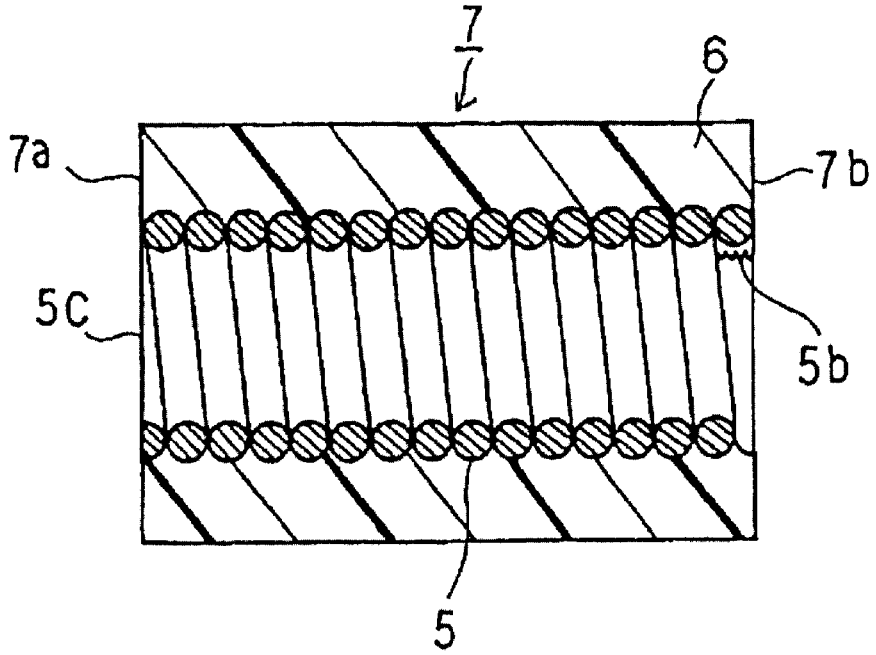
Fig.8 PRIOR ART
FIG. 8 is a sectional view showing the state of the molded body shown in FIG. 7 after being cut off at both ends thereof.
Figure 9:
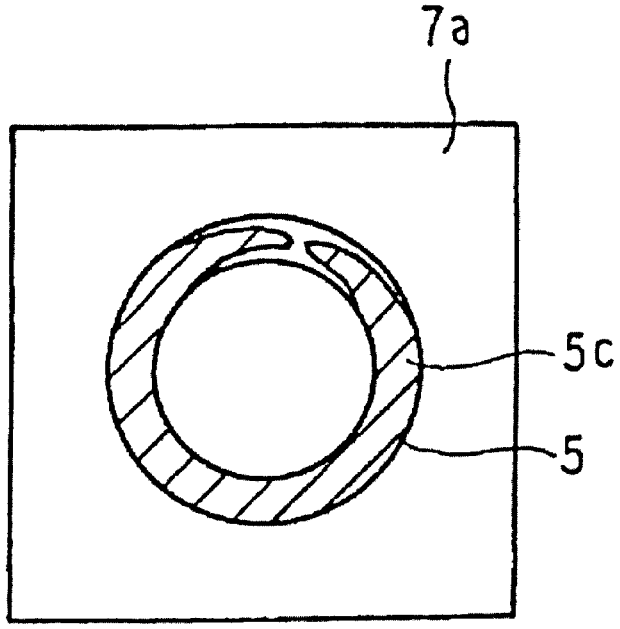
Fig.9 PRIOR ART
FIG. 9 is a side view showing the state of the end portion of the conductor coil in the cut-away plane 7*a* shown in FIG. 8.
Figure 10:
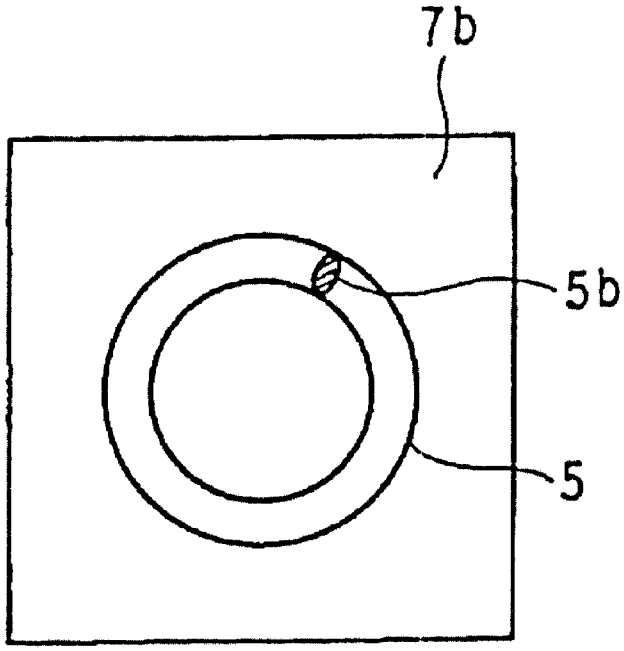
Fig.10 PRIOR ART
FIG. 10 is a side view showing the state of the end portion of the conductor coil in the cut-away plane 7*b* shown in FIG. 8.
Figure 11:
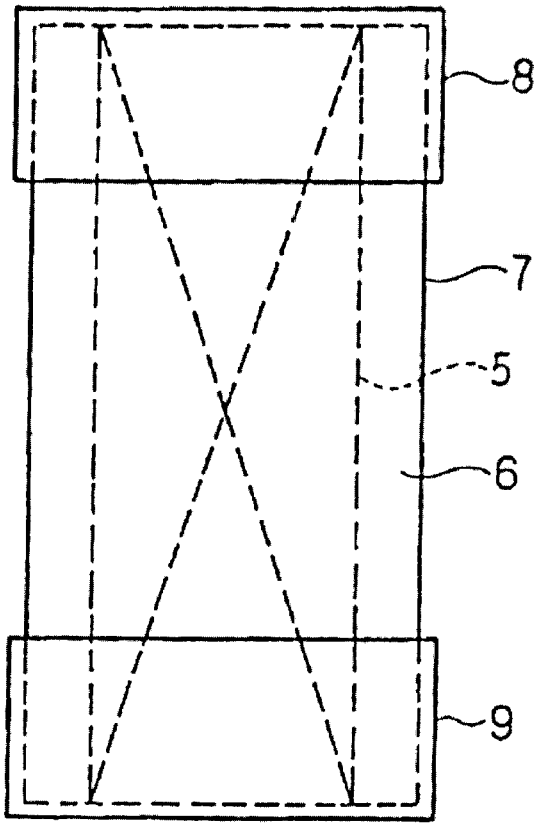
Fig.11 PRIOR ART
FIG. 11 is a side view showing a structure of the bead inductor.
Figure 12:
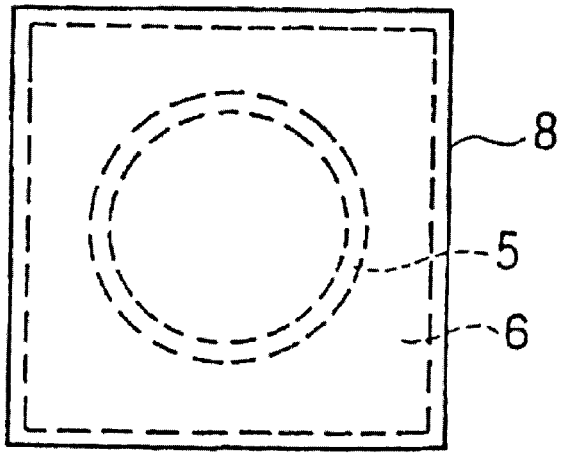
Fig.12 PRIOR ART
FIG. 12 is a plan view showing the structure of the bead inductor.

FIG. 3 is a sectional view showing the state of the molded body after being cut off along the cutting lines shown in FIG. 2. In this preferred embodiment, in the cut-away plane 14*a* exposed by cutting off along the cutting line A—A shown in FIG. 2, the conductor coil 10 is cut along the plane so as to be flush with the cut-away plane 14*a*, while in the cut-away plane 14*b* exposed by cutting off along the cutting line B—B shown in FIG. 2, the conductor coil 10 is cut off with the wire material in a torn-off state like in the cut-away plane 7*b* of the molded body shown in FIG. 8.

However, the cutting is performed within the region of the soldered portion 11 in which insulation coating is removed therefrom via soldering before molding. Accordingly, the insulation coating on the exposed portions of the conductor coil 10 on the side of the cut-away plane 14*b* has been removed. Therefore, these exposed portions can be utilized to be connected to an external terminal such as a metallic cap.

Since the cutting is also performed within the region of the soldered portion 12 on side of the cut-away plane 14*a*, the insulation coating on the exposed portions on the side of the cut-away plane 14*a* is removed.

Figure 4:
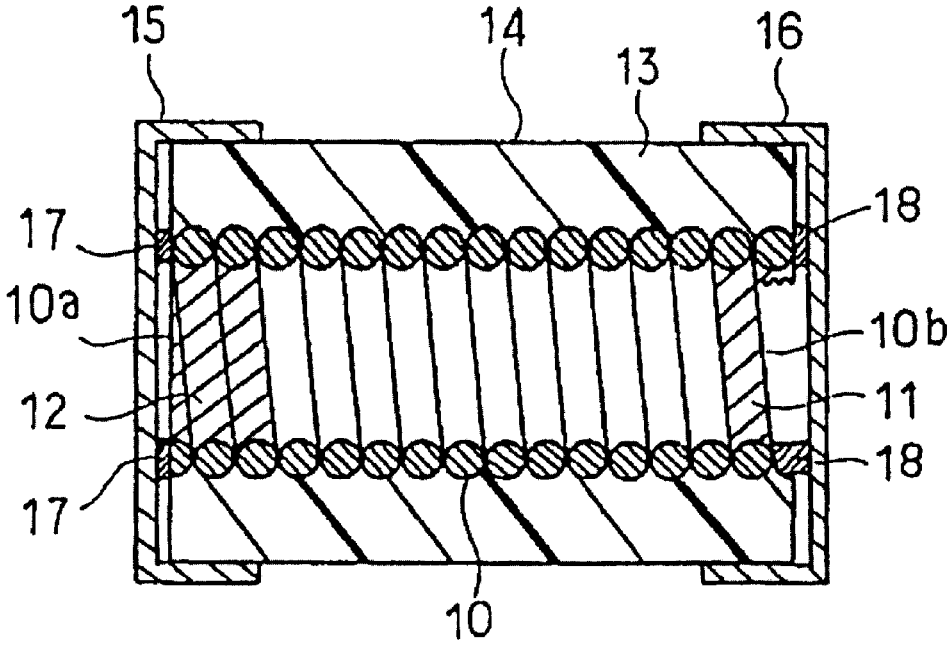
FIG. 4 is a sectional view showing the state of the molded body after the cutting step shown in FIG. 3 with metallic caps attached to both ends thereof to form a bead inductor.

FIG. 4 is a sectional view showing the state of the molded body shown in FIG. 3 with metallic caps defining external terminals being attached to both end portions thereof. Solder is added on the portions of the metallic wire of the conductor coil 10 exposed on the cut-away planes 14*a* and 14*b* by immersing both end portions of the molded body 14 shown in FIG. 3 into a solder bath. Since the insulation coating on the metallic wire of the conductor coil 10 exposed on the cut-away planes 14*a* and 14*b* has been removed as described above, solder is added on the entire exposed portion. Metallic caps 15 and 16 can be attached to both end portions of the molded body 14 by press-fitting the metallic caps 15 and 16 to both sides of the molded body 14 and then heating the caps 15, 16.

As shown in FIG. 4, the metallic cap 15 and the end portion 10*a* of the conductor coil 10 are electrically connected to each other via a soldered portion 17. Likewise, the metallic cap 16 and the end portion 10*b* of the conductor coil 10 are electrically connected to each other via a soldered portion 18. As shown in FIG. 4, although the conductor coil 10 is cut off in a torn-off state on the side of the end portion 10*b*, since the insulation coating on the surface of the conductor coil 10 has been removed, the solder is satisfactorily added thereon so that the end portion 10*b* of the conductor coil 10 and the metallic cap 16 are connected to each other via the soldered portion 18. This results in substantial increases in the degree of reliability in the electrical connection of the conductor coil to the metallic caps. Since both end portions 10*a* and 10*b* of the conductor coil 10 are located within the region of the soldered portions 12 and 11, respectively, they have excellent solder-wetting properties, and the soldering will be extremely good. This results in a further increase in the degree of reliability of the electrical connection.

Whereas in the above-described preferred embodiment, a resin body including a powdered magnetic substance has been described as a resin body including ferrite powder as an example, the present invention is not limited to this powder, and a resin body including other various powdered magnetic substances may be used. A rubber body including a powdered magnetic substance may also be used.

Whereas in the above-described preferred embodiment the metallic caps are attached to the exposed end portions of the conductor coil via soldering, the present invention is not limited to soldering, and metallic caps as external terminals may be attached via conductive paste or spot welding or other suitable method.

Whereas in the above-described preferred embodiment the metallic wire forming the conductor coil is described as a copper wire having a polyester resin layer as an example, the present invention is, not limited to copper wire and other metallic wires which have been coated for insulation may be used.

In accordance with preferred embodiments of the present invention, by immersing both end portions of the conductor coil into a melted solder bath prior to the forming step, to remove insulation coating on both end portions thereof, a conductor coil which is exposed by the cutting of the molded body without insulation coating can be achieved. Therefore, a sufficient connecting area of the end portions of the conductor coil for electrical connection to external terminals is reliably provided, resulting in sharply increased reliability of connection between the conductor coil and external terminals.

Since the external terminals may be attached to the exposed end portions of the conductor coil having excellent solder-wetting properties by soldering according to a preferred embodiment of the present invention, highly reliable soldering is performed, resulting in further increases in reliability of connection between the external terminals and the conductor coil.

In a bead inductor of general design, the region immersed into a melted solder bath according to one preferred embodiment of the present invention may include the cutting region therein.

In accordance with another preferred embodiment of the present invention, since insulation coating on the end portions of the conductor coil at both end portions of the molded body is removed in advance, sufficient connecting area for the end portions of the conductor coil for electrical connection to external terminals is reliably provided, resulting in a significant increase in reliability of connection between the conductor coil and external terminals.

The external terminals according to another preferred embodiment of the present invention may in general be produced by using conventional metallic material, resulting in production of a chip inductor having increased reliability of connection between the metallic caps defining external terminals and the conductor coil.

While the invention has been particularly shown and described with reference to preferred embodiments thereof, it will be understood by those skilled in the art that the foregoing and other changes in form and details may be made therein without departing from the spirit of the invention.

What is claimed is:

1. A bead inductor comprising:

a conductor coil defined by a wound, coated metallic wire, an insulation coating on both end portions including longitudinally extending portions of said conductor coil being removed therefrom;

a molded body being arranged such that said coil conductor is embedded in the molded body so that the end portions of said conductor coil, from which the insulation coating is removed, are exposed at both end portions of said molded body; and external terminals attached to end portions of said conductor coil at both end portions of said molded body so that the end portions of said conductor coil are electrically connected to the external terminals.

2. A bead inductor according to claim 1, wherein said external terminals are metallic caps which are fitted to both end portions of said molded body.

3. A bead inductor according to claim 1, wherein said external terminals are soldered to the exposed end portions of the conductor coil.

4. A bead inductor according to claim 1, wherein the molded body is formed of a resin body including ferrite powder.

5. A bead inductor according to claim 1, wherein the molded body is formed via injection molding.

6. A bead inductor according to claim 1, wherein the molded body is formed of a rubber material including ferrite powder.

7. A bead inductor according to claim 1, wherein the molded body is formed of a polyphenylene sulfide resin including about 88% by weight of a Ni—Cu—Zn ferrite powder.

8. A bead inductor according to claim 1, wherein the external terminals are attached to the ends of the coil conductor via spot welding.

9. A bead inductor according to claim 1, wherein the external terminals are attached to the end portions of the coil conductor via conductive paste.

10. A bead inductor according to claim 1, wherein the coil conductor comprises a copper coil having a polyester resin layer disposed thereon.

* * * * *